United States Patent [19]

Corbo et al.

[11] Patent Number: 5,071,051

[45] **Date of Patent: * Dec. 10, 1991**

[54] REUSABLE TAPE DISPENSER

[75] Inventors: Thomas A. Corbo, Gate Mills; Brian A. Vulpitta, Avon Lake; Alan R. Greenleaf, Westlake; Richard J. Kicak, Jr., Lagrange, all of Ohio

[73] Assignee: Manco, Inc., Westlake, Ohio

[ * ] Notice: The portion of the term of this patent subsequent to Oct. 9, 2007 has been disclaimed.

[21] Appl. No.: 574,109

[22] Filed: Aug. 29, 1990

Related U.S. Application Data

[63] Continuation of Ser. No. 363,639, Jun. 8, 1989, Pat. No. 4,961,525.

[51] Int. Cl.[5] ..... B65D 85/672; B26F 3/02

[52] U.S. Cl. ..... 225/65; 225/56; 225/66; 225/88

[58] Field of Search ..... 225/56, 58, 66, 65, 225/47, 25, 26, 88; 403/344, 381

[56] References Cited

U.S. PATENT DOCUMENTS

| | | | |
|---|---|---|---|
| 3,378,184 | 4/1968 | Mallory | 225/66 |
| 3,417,935 | 12/1968 | Douglas et al. | 242/55.2 |
| 3,972,459 | 8/1976 | Cooper | 225/47 |
| 4,225,071 | 9/1980 | Laviano | 225/65 |
| 4,358,328 | 11/1982 | Pearson | 156/73.1 |
| 4,401,248 | 8/1983 | Helms | 225/47 |
| 4,405,068 | 9/1983 | Blair | 225/65 |
| 4,627,560 | 12/1986 | Samuelson | 225/66 |

*Primary Examiner*—Mark Rosenbaum
*Assistant Examiner*—Rinaldi Rada
*Attorney, Agent, or Firm*—Body, Vickers & Daniels

[57] ABSTRACT

A tape dispenser comprising a molded plastic frame having a base wall portion with a tape cutting edge and a pair of flexurable side wall arm portions extending in generally parallel side-by-side relation from the base wall portion and provided with C-shaped wall portions having opposed arcuate hub portions extending inwardly therefrom and adapted to support a tape roll. The hub portions are provided with axially engageable and releasable locking means adjacent the free ends of the C-shaped wall portions for firmly joining the hub portions together thereat simply by relative pivotal flexure movement of the arm portions to rigidify the dispenser.

11 Claims, 3 Drawing Sheets

FIG. 6
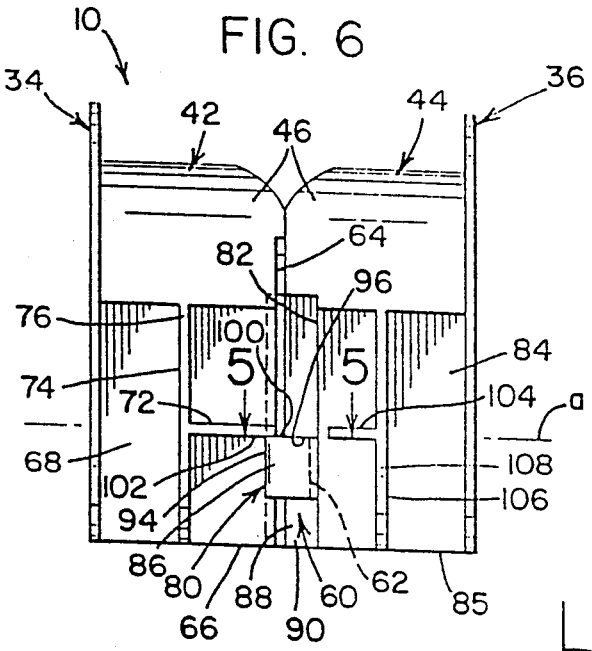
FIG. 7
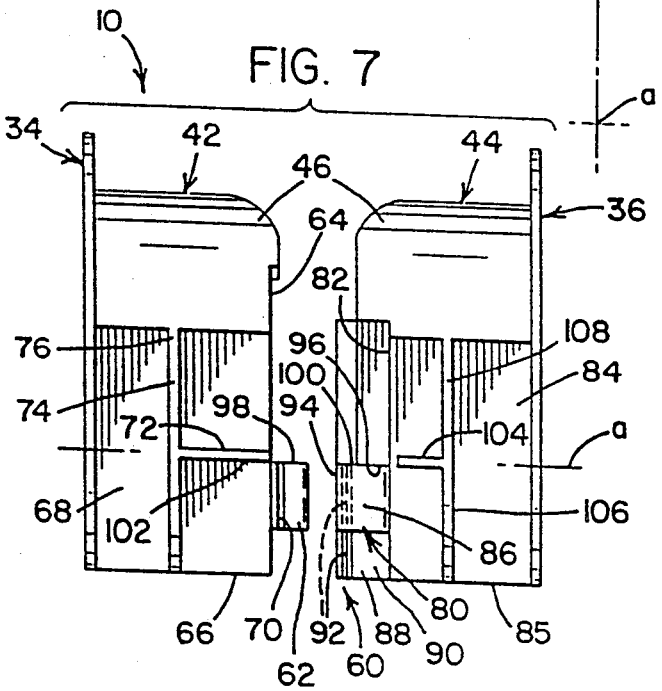
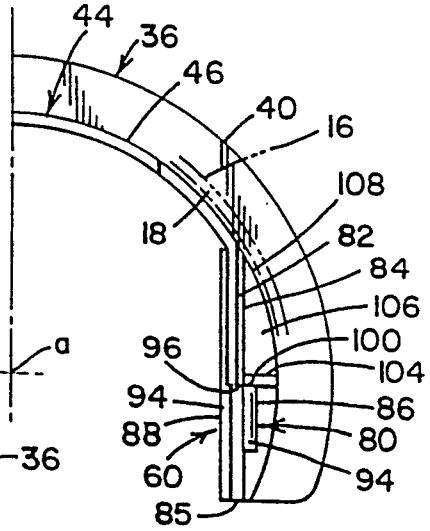
FIG. 8

REUSABLE TAPE DISPENSER

This is a continuation of application Ser. No. 363,639 filed June 8, 1989, now U.S. Pat. No. 4,961,525.

This invention relates in general to hand held tape dispensers from which tape may be dispensed and severed from tape remaining in the dispenser.

BACKGROUND OF THE INVENTION

Dispensers for pressure-sensitive tapes are known which usually comprise an integral molded plastic frame of U-shape and including a planar tape guide wall and tape severing portion from the opposite side edges of which a pair of flexurable tape roll support arms extend in spaced, generally parallel relation. The support arms are formed with opposed C-shaped portions at a location spaced from and more or less centered on an axis in the plane of the guide wall portion. The C-shaped portions are provided with inwardly facing and axially aligned hub portions for rotatably supporting a roll of tape thereon.

While such type tape dispensers perform satisfactorily to dispense tape wound on cores having a comparatively small size central opening, such as 1½ inches or so, species of that dispenser sized to dispense tape wound on considerably larger diameter cores, e.g., cores having a 3 inch diameter central opening, have been found to be unstable when used to dispense or cut tape, particularly where the tape is of a type difficult to cut such as conventional filament tape.

U.S. Pat. No. 3,417,935 discloses a tape dispenser formed of a single plastic molding having a planar front wall portion formed with a serrated tape-cutting edge and having side wall portions extending from its side edges which are bent to extend parallel to each other and which are provided with completely circular opposed hub portions which are snap-locked together around their circular extent. While such type tape dispensers with full circle hub portions are satisfactory to dispense tape wound on cores with small diameter center openings of 1½ inches or so, they also are unsatisfactory for dispensing tapes wound on cores having the considerably larger size center openings of 3 inches in diameter, in that such dispensers then involve an inordinate amount of plastic material and are unwieldy and difficult to handle, particularly when removing an empty core and installing a replacement tape roll.

SUMMARY OF THE INVENTION

The present invention contemplates a new and improved tape dispenser of the type described above which overcomes all of the above referred to problems and others and provides a tape dispenser which has the stability needed to dispense and cut tapes wound on cores having conventional 3 inch diameter center openings, even when the tape is of a type difficult to cut.

Briefly stated, in accordance with the present invention, there is provided a tape dispenser of the type described above adapted to support a roll of tape wound on a core having a comparatively large diameter center opening such as the conventional 3 inch center opening, in which the semi-cylindrical hub portions on the respective C-shaped side arms of the frame are provided with snap interlocking means adjacent the free ends thereof. This snap interlocking means is readily engageable on relative pivotal movement of the side arms and associated hub portions toward each other to hold the hub portions in stable position relative to each other.

According to another aspect of the invention, the interlocking means comprises a prong member extending axially from the inner edge of one of the hub portions and easily snap locked into a female socket member extending axially from the inner edge of the other one of the hub portions and having a pair of clutch jaws for axially receiving and snap locking onto the prong to lock the two hub portions firmly together in stable axially related position.

According to still another aspect of the invention, the locking prong member on the one hub portion of the frame is provided with a pair of small V-shaped locking ribs on its opposite side faces which snap-lock into matching V-shaped grooves in the jaw faces of the clutch arms of the female socket member on the other one of the hub portions to lock the two hub portions firmly together in their joined position against pivotal separating movement relative to one another.

The principal object of the invention is to provide a tape dispenser having the necessary stability for use to dispense tape wound on comparatively large diameter cores.

Another object of the invention is to provide a tape dispenser with novel axially engageable locking means for joining the hub portions of the dispenser together.

Still another object of the invention is to provide a tape dispenser having hub portions which are firmly lockable together adjacent their free ends and separable from each other simply by pivotal movement of the hub portions relative to one another.

Further objects and advantages of the invention will be apparent from the following detailed description of a preferred species thereof and from the accompanying drawings.

BRIEF DESCRIPTION OF THE DRAWINGS

In the drawings:

FIG. 6 is an end elevational view taken on line 6—6 of FIG. 3;

FIG. 7 is an end elevational view taken on line 7—7 of FIG. 4; and,

FIG. 8 is a fragmentary side elevational view taken on the line 8—8 of FIG. 4.

Figure 1:
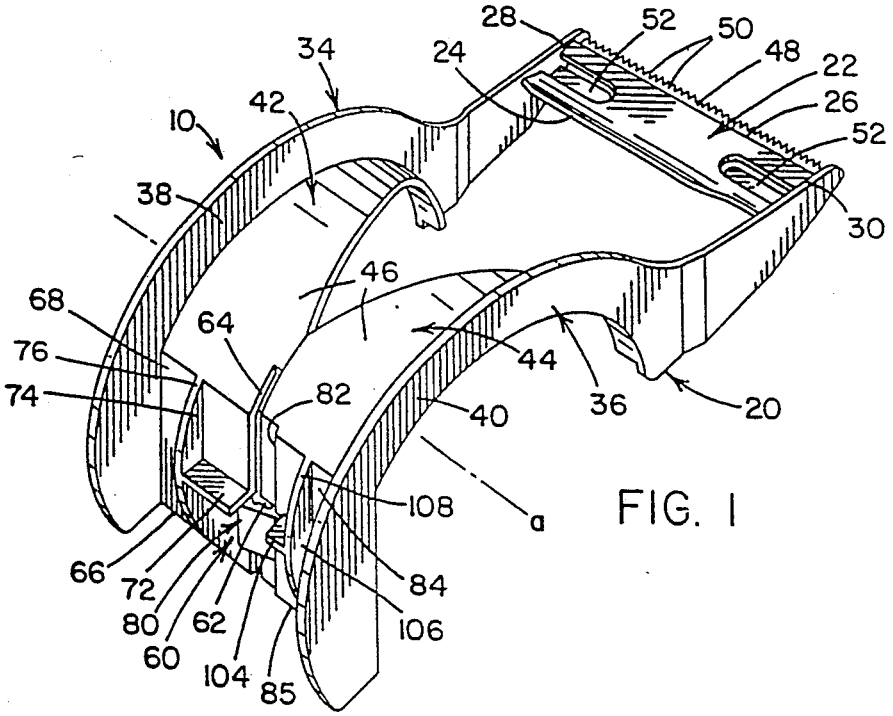
FIG. 1 is a perspective view of a tape dispenser according to the invention in its tape roll supporting position.

Referring now to the drawings wherein the showings are for the purposes of illustrating a preferred embodiment of the invention only and not for the purposes of limiting same, the figures show a tape dispenser 10 for a roll 12 of tape 14 such as pressure sensitive adhesive coated tape wound on a core 16 having a comparatively large size, e.g., an approximately 3 inch diameter inner or center opening 18. The tape dispenser 10 is adapted to be hand held and used to dispense a length of the tape 14 from the roll 12 and to then cut the dispensed length of tape 14 from the supply thereof remaining on the roll 12.

The tape dispenser 10 comprises an integrally molded generally U-shaped frame 20 of a suitable thermoplastic resin such as polystyrene and including a tape guide or base wall portion 22 of generally rectangular shape having parallel inner and outer end edges 24 and 26 extending between opposite parallel side edges 28 and 30 and a generally planar tape guide surface 32. The frame 20 also includes a pair of generally parallel side wall or side arm portions 34 and 36 extending along the opposite side edges 28, 30 of the tape guide wall portion 22, disposed approximately at right angles to the plane of the guide surface 32, and projecting from the guide wall portion 22 in the direction of the respective side edges 28, 30 and beyond the inner edge 24 thereof.

The side wall or arm portions 34 and 36 of the frame 20 are formed with opposed complementary C-shaped portions 38 and 40 spaced from the inner end edge 24 of the tape guide wall portion 22 and of generally semi-circular form centered, when the dispenser is in its use condition, approximately in the plane of the tape guide wall portion 22 about a common axis a parallel to the outer edge 26 of the tape guide wall portion 20. The C-shaped side wall portions 38 and 40 of the side arm portions 34 and 36 are provided with opposed arcuate hub portions 42 and 44 of semi-cylindrical shape centered on the axis a and projecting inwardly toward each other from the inner peripheral edges of the respective C-shaped side wall portions 38, 40. The hub portions 42 and 44 have arcuate or semi-cylindrical outer surfaces 46 adapted to support the roll 12 of pressure sensitive adhesive coated tape 14 for rotation about the juxtapositioned hub portions 42, 44, with the periphery of the roll 12 spaced a slight distance from the inner edge 24 of the guide wall portion 22 as shown in FIG. 1. The C-shaped portions 38, 40 of the side wall or side arm portions 34, 36 of the frame 20 project radially outward beyond or above the arcuate outer surfaces 46 of the hub portions 42, 44 to provide side edge flanges thereon serving to keep the tape roll 12 in position around the hub portions 42, 44.

Means for cutting the tape 14 in the form of a serrated cutter blade 48 with a saw tooth cutting edge 50 is mounted on the guide wall portion 22 with the cutting edge 50 projecting from the outer edge 26 of the guide wall portion 20 so that tape can be pulled from the roll 12, around the inner edge 24 of the tape guide wall portion 22, and along the tape guide surface 32 under opposed tabs 52 projecting inwardly from the side wall portions 34, 36 which help to maintain the cut end of the tape in position adjacent the guide surface 32 and out of contact with the surface of the tape roll 12 when the dispenser is not in use. After a desired length of the tape 14 has thus been dispensed from the roll 12, the dispensed length of tape may be severed from the tape still remaining on the roll 12 by manually manipulating the dispenser to bring the cutter blade 48 into cutting engagement with the tape 14.

Figure 2:
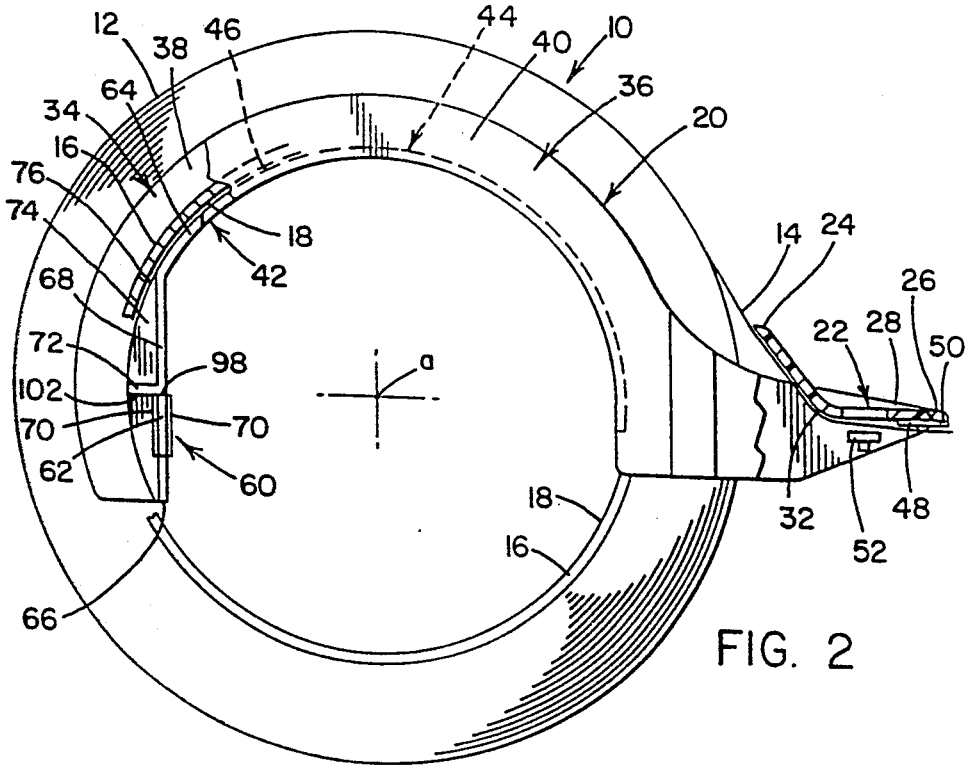
FIG. 2 is a side elevational view on an enlarged scale of the tape dispenser according to the invention shown partly broken away.
Figure 3:
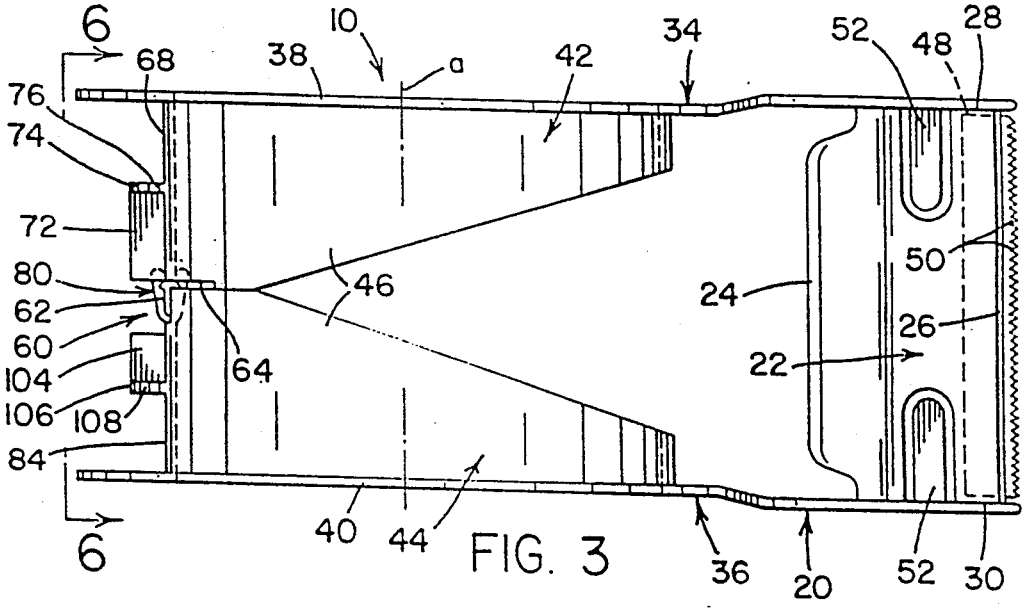
FIG. 3 is a plan view of the tape dispenser of FIG. 1 shown on an enlarged scale.
Figure 4:
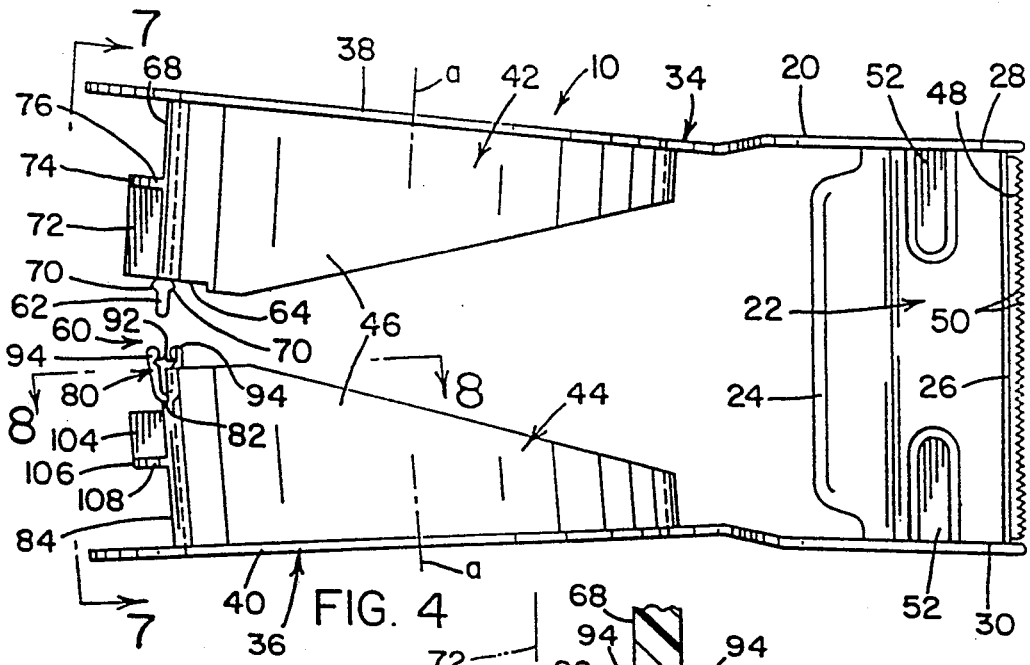
FIG. 4 is a plan view similar to FIG. 3 but showing the hubs of the tape dispenser separated from one another.
Figure 5:
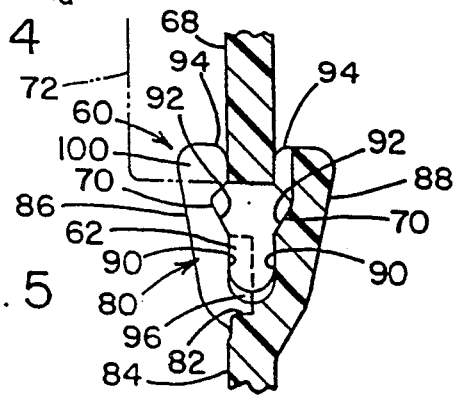
FIG. 5 is a further enlarged fragmentary sectional view taken on the line 5—5 of FIG. 6 showing the hub locking means of the tape dispenser in their engaged position.

The frame 20 of the dispenser 10 is molded with the hub portions 42, 44 spaced a slight distance apart and diverging at a slight angle of, for example, 8° from one another, as shown in FIG. 2, and together with their C-shaped side wall or side arm portions 34, 36 are resiliently bendable or flexurable to either pivotally move them axially closer together to engage snap-type locking means 60 comprising the invention provided on the free ends of the respective hub portions 42, 44 to lock the hub portions axially together in axially aligned relation with one another about common axis a, or to pivotally move the hub portions 34, 36 further apart to permit the insertion of the tape roll 12 therebetween and loading of the roll onto the hub portions and into the dispenser 10, or to permit the removal of an empty core 16 from the dispenser.

The locking means 60 according to the invention comprises a tab-like male prong member 62 projecting from the inner edge of one of the hub portions, in the case shown from the inner edge 64 of the hub portion 42, at a location adjacent the free end 66 thereof and generally diametrically opposite the guide wall portion 22 and in a direction axially of the hub portion. The prong member 62 extends from a chordal section 68 of the hub portion 64 in order to locate the prong member 62 inside the center opening 18 of the tape roll core 16 so as to lie clear of the same and not interfere with the rotational mounting of the tape roll 12 on the hub portion 64. The prong member 62 preferably comprises an extension of the wall of the hub portion 42 having the same thickness thereof, e.g., approximately 1/16 inch, and has a projecting length of around 5/32 inch and a width of around ⅜ inch.

Adjacent its base end where it meets with the inner edge 64 of the hub portion 42, the prong member 62 is formed with a pair of small V-shaped locking ribs 70 on its opposite sides extending across the width dimension of the prong member i.e., parallel to the inner edge 64 of the hub portion 42 and to the side wall 38 of the arm portion 34. To rigidify the chordal section 68 of the hub portion 42 against flexure and breakage, it is provided on its radially outer side with an axially extending shallow strengthening rib 72 and with a correspondingly shallow circumferentially extending strengthening rib 74 with which it meets. The radially outward or top edge 76 of the rib 74 is arcuately curved to constitute an extension of the cylindrical outer surface 46 of the hub portion 42.

The locking means 60 further comprises a female socket or claw-type clutch member 80 located on and projecting axially from the inner edge 82 of the chordal section 84 of the opposite hub portion 44, at a location adjacent the free end 85 thereof and opposite the prong member 72 so as to engage therewith and snap lock thereover when the two arm portions 34, 36 and their associated hub portions 42, 44 are pivotally closed together. The clutch member 80 comprises a spaced pair of outer and inner spring arms or flexurable jaws 86 and 88 (FIG. 7) formed on the chordal section 84 and extending toward the prong member 72, the arms 86 and 88 being provided with flat opposed inner faces 90 spaced apart a distance to receive the prong member 72 snugly therebetween, as shown in FIG. 7. The outer flexurable jaw 86 is of a width approximately corresponding to the ⅜ inch width of the prong member 62 while the other or inner flexurable jaw 88 extends approximately the full length of the chordal section 84 so as to be somewhat stiffer and more resistant to flexure than the outer flexurable jaw 86. The opposed inner faces 90 of the jaws 86, 88 are provided, adjacent their outward ends, with small V-shaped grooves 92 extending thereacross and parallel to the inner edge 82 of the chordal section 84 of the hub portion 44, for snap locking the locking ribs 70 of the prong member 62 therein when the two side arm portions 34, 36 and their associated hub portions 42, 44 are pivotally closed together, thereby firmly locking the hub portions in their axially aligned closed, tape roll supporting position against axial separation movement. The jaw faces 90 are formed with rounded outer edges 94 to facilitate the outward flexure of the jaws 86, 88 over the locking ribs 70 on the prong member 62 during the snap locking of the prong member into the clutch member 80.

To axially align the hub portions 42, 46 with one another when they are locked together by the locking means 60, the inward jaw 88 of the clutch member 80 is provided with an axially extending shoulder 96 against which the axially extending inward side edge 98 of the prong member 62 engages when the prong member 62 and clutch member 80 are moved together. Also for this aligning purpose, the inner side edge 100 of the outer jaw 86 of the clutch member 80 is adapted to engage against the outward side face 102 of the strengthening rib 72 on the hub portion 42 when the prong member 62 and clutch member 80 are snap locked together.

Like the chordal section 68 of hub portion 42, the chordal section 84 of the hub portion 44 is also provided on its radially outer side with an axially extending shallow strengthening rib 104 and with a correspondingly shallow circumferentially extending strengthening rib 106 with which it meets. As with the rib 74 on hub portion 42, the radially outward or top edge 108 of the circumferential rib 106 is arcuately curved to constitute an extension of the cylindrical outer surface 46 of the hub portion 44.

Because the locking means 60 according to the invention requires only pivotal movement of the arm portions 34, 36 and their associated hub portions 42, 44 toward or away from one another to effect either the snap-locking together or the releasing of the prong member 62 and the socket member 80, without any need for displacing or distorting the hub portions laterally of their axis relative to one another, the locking together of the hub portions 42, 44 for use of the dispenser 10, as well as the releasing of the locking means 60 for removal of an empty core 16 and loading of a replacement tape roll 12 into the dispenser 10, is therefore accomplished in a simple and easy manner by merely pushing the hub portions together or pulling them apart. The firm locking together of the hub portions 42, 44 at their free ends 66 and 85 by the locking means 60 according to the invention, moreover, imparts the necessary stability to the dispenser 10 to enable effective dispensing and cutting of the tape 14, especially tape of a type difficult to cut such as conventional filament tape. Also, the locking together of the hub portions 42, 44 by the locking means 60 provides the appropriate spacing between the C-shaped side wall portions 38, 40 that extend radially outward of the hub portions 42, 44 so as to serve as retaining flanges for locating and retaining the tape roll 12 in place on the hub portions.

The invention has been described with reference to the preferred embodiment. It will be appreciated that modifications or alterations could be made without deviating from the present invention. Such modification and alterations will occur to others upon their reading and understanding of this specification. It is intended that all such modifications and alterations be included insofar as they come within the scope of the appended claims or the equivalents thereof.

Having thus described the invention, it is claimed:

1. A roll tape dispenser comprising an integral molded plastic U-shaped frame including a forward tape guide wall portion having generally parallel extending forward outer and rearward inner edges, parallel opposite side edges, and a generally planar tape guide wall surface at its forward edge, said guide wall portion being provided with tape cutting means adapted to cut off a portion of tape from a roll of tape supported on said dispenser disposed along its said forward outer edge, and a pair of flexurable side wall arm portions disposed at right angles to the plane of said guide wall surface and extending along and rearwardly from the opposite side edges of said guide wall portion in generally side-by-side spaced apart relation, said arm portions being formed with complementary C-shaped side wall portions of arcuate shape, said arm portions being spaced rearwardly from said guide wall portion and centered on an axis approximately parallel to said forward outer edge and lying approximately in the plane of said guide wall surface, said C-shaped side wall portions terminating in corresponding free ends located generally diametrically opposite the said guide wall surface and said side wall arm portions being provided with inwardly facing opposed hub portions of generally semi-cylindrical shape centered approximately on said axis for rotatably supporting a tape roll thereon, said hub portions being arcuately coextensive with said C-shaped side wall portions and terminating in free ends located at the said free ends of said C-shaped side wall portions, said side wall arm portions being flexurable away from one another a sufficient distance to permit insertion of a tape roll between the separated hub portions for rotative mounting thereon, and said hub portions being provided with axially engageable and releasable snap-locking means located adjacent the said free ends thereof to firmly secure the said hub portions axially together thereat against axial separation, said locking means comprising a male prong member extending axially from one of said hub portions adjacent the said free end thereof and a female socket member extending axially from the other one of said hub portions for snaplocking, gripping engagement with said prong member and disengagement therefrom solely by pivotal flexure movement of said side wall arm portions and their associated said hub portions respectively toward and away from one another.

2. A tape dispenser as defined in claim 1 wherein the said hub portions are formed with chordal sections at their said free ends and the said locking means are provided on the said chordal sections of said hub portions.

3. A roll tape dispenser as defined in claim 1 wherein the said hub portions have facing inner edges and the said male prong member and the said female socket member extend axially of the respective said hub portions from the said facing inner edges thereof.

4. A roll tape dispenser comprising an integral molded plastic U-shaped frame member having a pair of flexurable side wall arm portions extending in generally parallel spaced apart relation from a base wall portion and provided with complementary C-shaped side wall portions of arcuate shape spaced from said base wall portions and centered on an axis lying approximately in the plane of said base wall portion, said C-shaped side wall portions terminating in corresponding free ends located generally diametrically opposite the said base wall portion and being provided with inwardly facing opposed hub portions of semi-cylindrical shape centered on said axis for rotatably supporting a tape roll thereon, said hub portions being arcuately coextensive with said C-shaped side wall portions and terminating in free ends located at the said free ends of said C-shaped side wall portions, and said hub portions being provided with axially engageable and releasable locking means located adjacent the said free ends thereof to firmly secure the said hub portions axially together thereat against axial separation, said locking means comprising a male prong member extending axially from one of said hub portions adjacent the said free end thereof and a female socket member extending from the other one of said hub portions for snap-locking gripping engagement with said prong member and disengagement therefrom solely by pivotal flexure movement of said side wall arm portions and their associated said hub portions respectively toward and away from one another.

5. A roll tape dispenser as defined in claim 4 wherein the said hub portions each have a radially outward side and are each provided with an axially extending shoulder on the said radially outward side thereof for engaging with respective axially extending side edges of the said male prong member and said female socket member to axially align the hub portions in their locked together position.

6. A roll tape dispenser as defined in claim 4 wherein said male prong member is in the form of a flat tab-shape member and the female socket member is in the form of a claw-type clutch member comprising a pair of spaced flexurable jaws.

7. A roll dispenser as defined in claim 6 wherein the said tab-shaped male prong member is provided with a pair of V-section locking ribs extending across the opposite flat side faces thereof, and the gripping faces of the said jaws of said female socket member are provided with a pair of V-section locking grooves extending thereacross for snap-locking over and onto the said locking ribs of said male prong member to maintain the hub portions in axially locked together position against axial separation.

8. A roll tape dispenser comprising a frame including a tape guide portion provided with tape cutting means adapted to cut off a portion of tape from a roll of tape supported on said dispenser, a pair of flexurable side wall arm portions extending rearwardly from said tape guide portion in generally side-by-side spaced apart relation, said side wall arm portions being formed with side wall portions of arcuate shape spaced rearwardly from said tape guide portion, said side wall portions terminating in corresponding free ends located generally diametrically opposite from said tape guide portion, said side wall portions being provided with inwardly facing opposed hub portions of generally semi-cylindrical shape adapted for rotatably supporting a tape roll thereon, said hub portions terminating in free ends located at the said free ends of said side wall portions, said side wall arm portions being flexurable away from one another a sufficient distance to permit insertion of a tape roll between the separated said hub portions for rotative mounting thereon, and said hub portions being provided with axial engageable and releasable snap-locking means located adjacent the said free ends thereof to firmly secure the said hub portions axially together thereat against axial separation, said locking means comprising a male prong member extending axially from one of said hub portions adjacent the said free end thereof and a female socket member extending axially from the other one of said hub portions adjacent the said free end thereof for snap-locking gripping engagement with said prong member and disengagement therefrom solely by pivotal flexure movement of said side wall arm portions and their associated said hub portions respectively toward and away from one another.

9. A roll tape dispenser as defined in claim 8 wherein the said hub portions each have a radially outward side and are each provided with an axially extending shoulder on the said radially outward side thereof for engaging with respective axially extending side edges of the said male prong member and said female socket member to axially align the hub portions in their locked together position.

10. A roll tape dispenser as defined in claim 8 wherein said male prong member is in the form of a flat tab-shape member and the female socket member is in the form of a claw-type clutch member comprising a pair of spaced flexurable jaws.

11. A roll dispenser as defined in claim 10 wherein the said tab-shaped male prong member is provided with a pair of V-section locking ribs extending across the opposite flat side faces thereof, and the gripping faces of the said jaws of said female socket member are provided with a pair of V-section locking grooves extending thereacross for snap-locking over and onto the said locking ribs of said male prong member to maintain the hub portions in axially locked together position against axial separation.

* * * * *